US005206613A

United States Patent [19]

Collier et al.

[11] Patent Number: 5,206,613

[45] Date of Patent: Apr. 27, 1993

[54] MEASURING THE ABILITY OF ELECTROPTIC MATERIALS TO PHASE SHAFT RF ENERGY

[75] Inventors: Donald C. Collier, Newtown; Kevin J. Krug, Stamford; Brittan Kustom, Wilton, all of Conn.

[73] Assignee: United Technologies Corporation, Hartford, Conn.

[21] Appl. No.: 794,267

[22] Filed: Nov. 19, 1991

[51] Int. Cl.[5] ..... H01P 1/18

[52] U.S. Cl. ..... 333/156; 333/157; 333/239; 343/754

[58] Field of Search ..... 333/156–158, 333/239; 343/754, 756, 909

[56] References Cited

U.S. PATENT DOCUMENTS

| | | | |
|---|---|---|---|
| 4,323,901 | 4/1982 | De Wames et al. | 343/754 |
| 4,480,254 | 10/1984 | Spencer et al. | 343/754 X |
| 4,636,799 | 1/1987 | Kubick | 343/754 |
| 4,706,094 | 11/1987 | Kubick | 343/754 |
| 4,809,011 | 2/1989 | Kunz | 343/754 |
| 5,032,805 | 7/1991 | Elmer et al. | 333/156 |

*Primary Examiner*—Steven Mottola
*Assistant Examiner*—Seung Ham
*Attorney, Agent, or Firm*—Richard H. Kosakowski

[57] ABSTRACT

A phase shifter for use in a phased array antenna includes a waveguide flange of metallic material has a narrow slot formed therein, the slot having ferroelectric material disposed uniformly therein. The slot is of reduced height relative to normal waveguide dimension, such height reduction minimizing the voltage applied across the material RF energy radiating from a source is directed to pass through the ferroelectric material. A single, thin conductive plate is disposed in the center of the slot, the plate having an electrical DC voltage imposed thereon. Such voltage creates an electric field across the material, which for a uniaxial ferroelectric orients the optic axis in a direction which is both normal to the direction of propagation of the radiation and parallel to the polarization direction of the radiation. The electric field changes the wave propagation constant (i.e., for a uniaxial ferroelectric, the extraordinary wave refractive index, $n_e$), producing a varying path length of the radiation in the material, resulting in a controllable alteration of the radiation phase. The varying phase shift is either used to control an antenna's radiating direction, or is detected by a measuring device to test the material itself.

13 Claims, 1 Drawing Sheet

MEASURING THE ABILITY OF ELECTROPTIC MATERIALS TO PHASE SHAFT RF ENERGY

TECHNICAL FIELD

This invention relates to phase shifting of an RF wave, and more particularly to an RF phase shifter in a waveguide flange, and a means to measure phase shift and electrooptic activity of materials in the RF frequency range.

BACKGROUND ART

Modern phased array antennas are limited in their application primarily by cost. Even utilizing the latest MMIC technology, the required phase shifters have a unit cost in excess of $500. With a typical array requiring 3000 individual antenna elements, each with its own phase shifter, the array price quickly becomes prohibitive.

Numerous attempts have been made to lower the cost of phased array elements. Investigations were made into the use of PIN diodes, since the diodes lent themselves to an inexpensive phase shifter design. However, no way was discovered to avoid the high insertion losses associated with the diodes, especially at the Ku frequency band and above.

Ferrite phase shifters gained popularity in recent years, as initial problems of weight, size and operational speed were overcome. But unit cost and complexity have hindered them from becoming a preferred building block.

More recently, use of ferroelectric materials has been of interest. This is because certain dielectric properties of such materials change under the influence of an electric field. In particular, an electrooptic effect can be produced by the application of a bias electric field to ferroelectric materials. By electrooptically varying the refractive indices of such material, a phase shift will occur in electromagnetic radiation passing therethrough. The overall procedure is known as electrooptic phase-shifting.

Regions of ferroelectric materials have a non-zero electric dipole moment in the absence of an applied electric field. For this reason, ferroelectric materials are regarded as spontaneously polarized.

A suitably oriented polarized ferroelectric medium changes the propagation conditions of passing electromagnetic radiation. A bias electric field of sufficient magnitude in the appropriate direction may change the refractive index of the medium, thereby further altering the propagation conditions.

Upon incidence with a uniaxial ferroelectric medium having a suitably aligned optic axis, radiation divides into two components (i.e., double refraction). A first component exhibits polarization of the electric field perpendicular to the optic axis, and refracts in the medium according to Snell's Law (the ordinary ray). A second component exhibits polarization orthogonal to that of the first, with some constituent of the electric field parallel to the optic axis (the extraordinary ray). The extraordinary ray is refracted in a different manner, and may not behave according to Snell's Law.

The refractive indices of the ferroelectric material for the two wave components, $n_o$ and $n_e$ respectively, determine the different velocities of propagation of the components' phase fronts. The applied bias electric field typically changes the refractive indices, which causes phase shifts in the propagating radiation.

Examples of radar scanning devices which purported to take advantage of the foregoing principles of ferroelectric materials are disclosed and claimed in U.S. Pat. Nos. 4,636,799 and 4,706,094, both to Kubick, both assigned to the assignee of the present invention, and both of which are hereby incorporated by reference. Each patent describes and illustrates a monolithic piece of ferroelectric material disposed in front of a source of electromagnetic radio frequency ("RF") radiation. The material has a row of electrically conductive wires disposed on each side of the material and spanning the material from top to bottom. A DC voltage applied to the wires in a pattern produces a voltage gradient across the antenna aperture from one end to the other. Such a voltage gradient purportedly causes a gradient in the refractive index of the material, with a resulting shift in the radiation direction, thereby effectuating ferroelectric scanning.

Further, the ferroelectric material in Kubick U.S. Pat. No. 4,706,094 (the "electrooptic scanner patent") has an initial domain orientation parallel to the direction of propagation ("c-poled"), such c-poling being perpendicular to the surface of the ferroelectric material. With such c-poling, the radiation is affected only by the ordinary index of refraction, $n_o$. However, it has been found experimentally that the electrooptic effect manifests itself more commonly in the extraordinary wave refractive index, $n_e$. Thus, to achieve wave phase shifting, the polarization must be parallel to the optic axis, and, thus, to the bias electric field.

In co-pending U.S. patent application Ser. No. 07/791,842, to Collier et al., and assigned to the assignee of the present invention, a phased array antenna comprising an arrangement of ferroelectric material is disclosed and claimed. The antenna purports to take advantage of the experimental discovery above in which the polarization must be parallel to the optic axis, and, thus, to the bias electric field in order to achieve phase shifting of RF energy. An obstacle to the use of ferroelectric material in such phased array antennas has been the lack of apparatus for accurately measuring the phase-shifting ability (electrooptic activity) of such material at RF frequencies.

DISCLOSURE OF INVENTION

Objects of the present invention include provision of a ferroelectric electrooptic phase shifter for use in, e.g., phased array antennas. Further objects include the provision of apparatus for measuring both the change in refractive index of a uniaxial electrooptic material and the electromagnetic radiation phase shifting ability of ferroelectric material used in such a phase shifter.

According to the present invention, a phase shifter for use in phased array antennas comprising a waveguide flange of metallic material has a narrow slot formed therein, the slot having ferroelectric material disposed uniformly therein. The slot is of reduced height relative to normal waveguide dimension, such height reduction minimizing the voltage applied across the material. RF energy radiating from a source is directed to pass through the ferroelectric material. A single, thin conductive plate is disposed in the center of the slot, the plate having an electrical DC voltage imposed thereon. Such voltage creates an electric field across the material, which for a uniaxial ferroelectric orients the optic axis in a direction which is both normal to the direction of propagation of the radiation and parallel to the polarization direction of the radiation. The electric field changes the wave propagation constant (i.e., for a uniaxial ferroelectric, the extraordinary wave refractive index, $n_e$), producing a varying path length of the radiation in the material, resulting in a controllable alteration of the radiation phase. The varying phase shift is either used to control an antenna's radiating direction, or is detected by a measuring device to test the material itself.

In further accord with the present invention, the RF energy radiating from the source propagates through a waveguide before reaching the ferroelectric material, a first dimension of the guide preferably being constant along the entire length of the guide, a second dimension being varied in a decreasing direction along some length of the guide, in order to transition the RF energy to the reduced height slot. Further, the phase shifted RF energy propagates through a waveguide between the ferroelectric material and measuring device, a first dimension of the guide preferably being constant along the entire length of the guide, a second dimension being varied in an increasing direction along some length of the guide, in order to transition the RF energy from the reduced height slot.

In still further accord with the present invention, the ferroelectric material disposed in the slot has a layer of impedance matching material disposed on each side thereof, the layers aiding in the transfer of RF energy into and out of the ferroelectric material, thereby reducing the amount of reflection of the RF energy off surfaces of the ferroelectric material. The phase shifter device comprises the ferroelectric material with impedance matching layers and conductive plate.

The present invention has utility in providing for relatively simple and inexpensive apparatus for measuring the electromagnetic radiation phase shifting ability of the electrooptic materials. In this way, the phase shifter can be tested before insertion into radar scanning devices such as phased array antennas.

These and other objects, features and advantages of the present invention will become more apparent in light of the detailed description of a best mode embodiment thereof, as illustrated in the accompanying drawings.

BEST MODE FOR CARRYING OUT THE INVENTION

Figure 2:
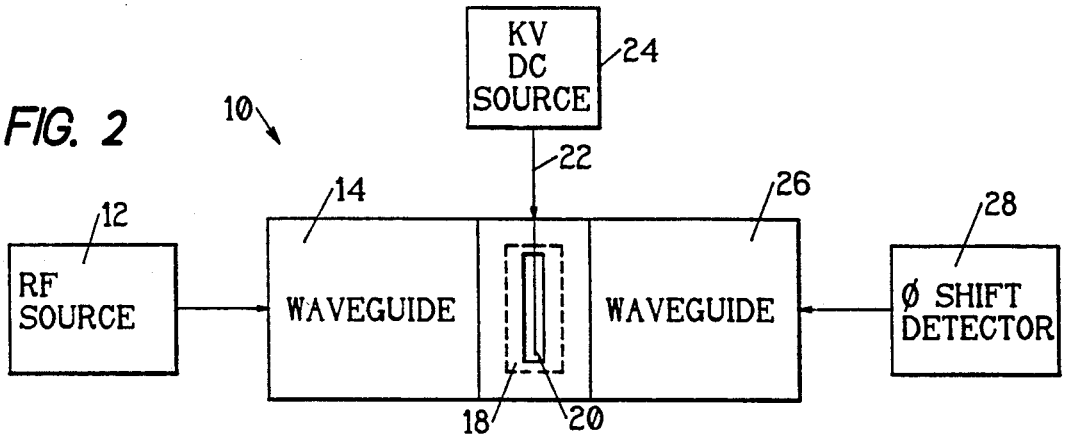
FIG. 2 is a block diagram of apparatus for measuring RF energy phase shift in the phase shifter of FIG. 1.

FIG. 2 is a block diagram of apparatus 10 for measuring the electromagnetic radiation phase shifting ability of a phase shifter 16 for use in, e.g., phased array antennas. Electromagnetic radio frequency ("RF") radiation is provided by a known RF source 12 at a selected frequency. The frequency may be within the X band (8.2 GHz to 12.4 GHz) or Ku band (12.4 GHz to 18.6 GHz).

The RF energy is directed into a waveguide 14, described in greater detail hereinafter with respect to FIG. 3. The RF energy propagates in the guide 14 until it encounters the phase shifter 16, described in greater detail hereinafter with respect to FIG. 1. The phase shifter contains a sample of ferroelectric material 18. In the center of the ferroelectric material 18 is disposed a thin plate or electrode 20 of conductive material, e.g., nickel or silver. Fed to the electrode 20 on a signal line 22 is a DC voltage from a high voltage source 24. The voltage typically ranges up to several kilovolts ("KV").

The voltage on the electrode 20 sets up an electric field across the ferroelectric material 18. The electric field electrooptically varies the wave propagation constant (i.e., for a uniaxial ferroelectric, the extraordinary wave refractive index, $n_e$). Such variation changes the path length of the RF energy propagating therethrough, which has the further effect of shifting the phase of the wave as it exits the material 18. The phase shift varies directly with the magnitude of the DC voltage provided on the line 22.

After the wave propagates through the ferroelectric material 18, it enters a second waveguide 26 and propagates therethrough until it either continues down the remaining structure of a scanning antenna, or reaches a known detector 28 which detects the amount of phase shift induced into the wave. The detector 28 and RF source 12 together may comprise the Model HP8510 network analyzer manufactured by Hewlett Packard.

Figure 1A:
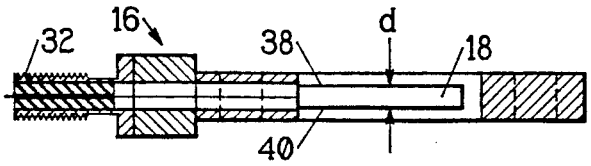
FIGS. 1*a* and 1*b* are top and front views of a phase shifter in accordance with the present invention.
Figure 1B:
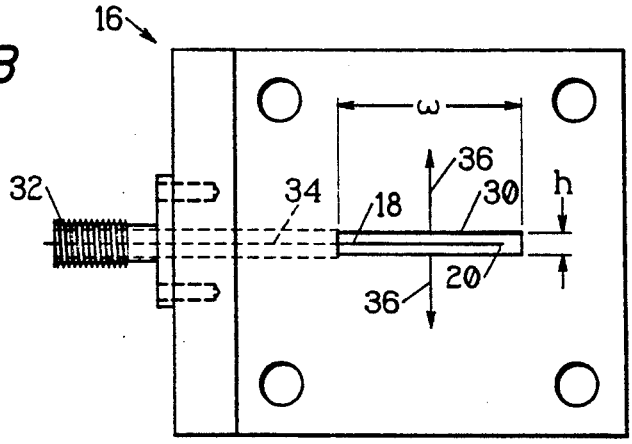

In FIGS. 1*a* and 1*b* are illustrated top and front views, respectively, of the phase shifter 16. The phase shifter comprises a flange-type portion of brass or other suitable metallic material. In the flange is formed a narrow rectangular slot 30 of height "h" and width "w". The ferroelectric material 18 is disposed completely in the slot 30. The ferroelectric material may comprise barium strontium titanate, or any other material, either ferroelectric or non-ferroelectric, having refractive index properties which vary in the presence of an applied electric field.

The ferroelectric material is disposed in the slot in the form of a planar layer of substantially uniform thickness "d". The thickness is selected to establish at least a single wavelength (i.e., $2\pi$ radian) phase delay under a selected electric field excitation level. The electrode 20 is disposed in the center of the ferroelectric material. Imposed upon the electrode is the DC voltage from the source 24. The DC voltage is fed to the flange by way of, e.g., a commercially available SSMA connector 32. From the connector 32, the DC voltage is fed to the electrode by a wire 34 disposed in the flange. The flange material is held at electrical ground.

The DC voltage establishes an electric field whose field lines originate from the electrode 20 and are directed both up and down (with respect to a vertical orientation of FIG. 1*b*). Directional lines 36 illustrate the direction of the electric field. Thus, the electric field is applied across the ferroelectric material in a vertical direction. A suitably oriented uniaxial ferroelectric material will be polarized so that its optic axis is also vertical. Changing the electric field will then vary the extraordinary wave refractive index, $n_e$, in the electrooptic ferroelectric material 18. Placing the electrode in the middle of the ferroelectric material isolates the electrode from the necessarily grounded waveguide, and also allows for a relatively low voltage requirement to achieve the desired electric field strength.

Located adjacent to the front and back sides of the ferroelectric material 18 are impedance matching layers 38,40. The layers 38,40 comprise material, e.g., magnesium calcium titanate having a dielectric constant in the range of 15–140. The refractive index is the square root of the dielectric constant, or relative permittivity. The layers are required because of the impedance mismatch between free space and the high dielectric constant (e.g., >500) of the ferroelectric material. Without these layers, the RF energy impinging upon the ferroelectric material would be reflected off the material faces. The resulting arrangement of ferroelectric material and layers has parallel front and back sides which are perpendicular to the propagation direction of the RF energy in the waveguides.

The magnesium calcium titanate is chosen to have a dielectric constant which equals the square root of the dielectric constant of the ferroelectric material. Such characteristic of the impedance matching layers provides for wide matching bandwidth. The layers are preferably fabricated into thin sheets or layers having a selected thickness. The layers are attached to each side of the ferroelectric material using adhesive or other known bonding techniques.

Assuming a dielectric constant of 625 for the ferroelectric material, the permittivity of each matching layer is 25 (i.e., the square root of 625). Low-loss microwave ceramics comprised of varying compositions of magnesium and calcium titanates are commercially available with dielectric constants in the range of 10 to 140, measured at the X frequency band. As these materials show no dispersion in the X band, it is expected that their dielectric properties will remain constant as the frequencies increase into the Ku frequency band. To achieve optimal radiation coupling, the impedance matching layers must be a quarter wavelength thick at the operating frequency. Such characteristic of the layers may reduce reflections of the radiation by nearly 100%. For a permittivity of 25, the matching layer thickness is 0.159 cm (about 59 mils) for operation at 10 GHz. Through use of impedance matching layers, the thickness, d, of the ferroelectric material can be freely varied, limited only by structural considerations and insertion loss.

Figure 3:
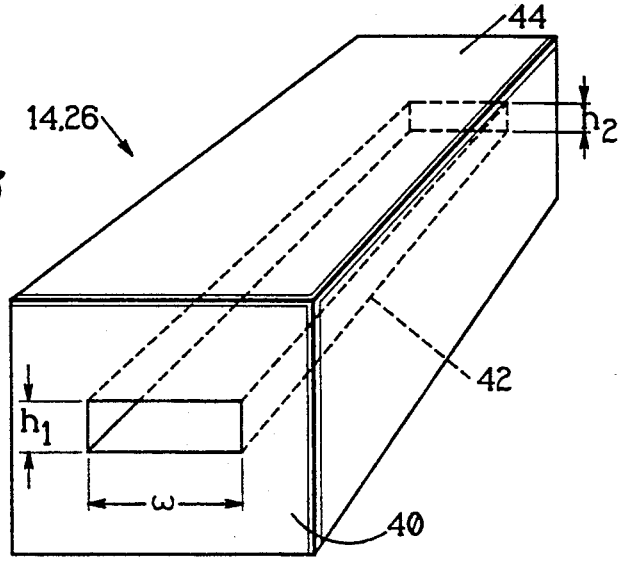
FIG. 3 is a perspective view of a waveguide portion of the apparatus of FIG. 2.

In FIG. 3 is illustrated a perspective view of a waveguide 14,26. Both guides are identical; therefore, the following discussion, although described in regard to guide 14 between the RF source and phase shifter, is applicable to either guide. The guide is comprised of brass or other suitable metallic material. The guide has a first planar surface 40 which interfaces with the RF source 12 or with a section of standard waveguide. Within the guide is formed an opening 42 through which the RF energy propagates. The opening 42 spans the entire length of the guide.

The opening 42 begins at the first surface 40 and has predetermined dimensions thereat. The dimensions depend on the frequency of the RF energy to be propagated in the guide. For example, it is well known that a waveguide designed to propagate frequencies in the Ku band has an opening with a height, $h_1$, of 0.311 inches and a width, w, of 0.622 inches. In an exemplary embodiment of the present invention for use in the Ku band, the opening at the first surface 40 has these exact dimensions.

However, in accordance with an aspect of the present invention, it is preferred to have a waveguide opening which gradually tapers downward in the height dimension along some (e.g., entire) length of the guide. In the exemplary embodiment, the length of the guide is approximately, e.g., five inches. The height dimension of the guide gradually tapers down along the length of the guide until it achieves a value, $h_2$, of 0.080 inches at a second planar surface 44 of the guide. The second planar surface 44 interfaces with the flange of the phase shifter 16. Such gradual taper is desired to avoid internal reflections of the RF energy in the guide. Such reflections may be caused by a relatively sharp drop off in the height dimension. The width, w, of the opening remains constant at 0.622 inches along the entire length of the guide.

Tapering the height dimension has no effect on the fundamental mode of the RF energy propagating in the guide. This is because the electric field polarization of the RF energy from the RF source is in a vertical direction. Further, the bias electric field across the ferroelectric material is also in a vertical direction. Because of these electric field orientations, the fundamental mode of the RF energy is not affected by the tapering of the height dimension. However, any tapering of the width dimension may affect the fundamental mode; therefore, the width is held constant along the entire length of the guide.

The taper of the height dimension to a smaller value at the point where the second planar surface of the waveguide interfaces with the phase shifter allows for smaller values of the voltage to produce the same induced electric field across the ferroelectric material.

The above discussion related to the guide disposed between the RF source and flange portion of the phase shifter is equally applicable to the guide 26 disposed between the phase shifter and detector 28. The guide 26 is disposed such that the first planar surface 40 interfaces with the detector or standard surface to the detector, and the second planar surface 44 interfaces with the flange portion of the phase shifter. Thus, the taper is arranged such that the larger height dimension is at the detector and the smaller height dimension is at the flange.

To effect a phase change in the RF energy, it was experimentally discovered that the bias electric field (corresponding to the direction of the optic axis) must be in a direction that is both normal to the propagation direction and parallel to the electric field polarization direction of the RF energy. The apparatus of the present invention is designed to operate on these principles. In operation of the present invention, the voltage applied to the plate creates an electric field across the ferroelectric material in a direction which is both normal to the direction of propagation of the radiation and parallel to the polarization direction of the radiation. The electric field changes the wave propagation constant (i.e., for a uniaxial ferroelectric, the extraordinary wave refractive index, $n_3$), producing a varying path length of the radiation in the material, resulting in a controllable phase of the radiation. The varying phase shift is detected by the measuring device.

The waveguides 14, 26 have been described as having a tapered height dimension. However, it is to be understood that, without limitation, dimensions other than the height may be tapered; further, in keeping with a broadest scope of the present invention, no dimension of the waveguide need be tapered, if desired. Further, the invention has been described for use in the X and Ku frequency bands. However, it is to be understood that the invention may be utilized in other frequency ranges as well in a manner that should be apparent from the teachings herein. In particular, the invention may be used throughout the microwave and millimeter wavelength ranges, corresponding to a frequency range of approximately 1 GHz to 100 GHz.

Although the invention has been illustrated and described with respect to a best mode embodiment thereof, it should be understood by those skilled in the art that the foregoing and various other changes, omissions, and additions in the form and detail thereof may be made without departing from the spirit and scope of the invention.

We claim:

1. Apparatus for phase shifting radio frequency ("RF") energy, comprising:

RF means, for providing the RF energy at a selected frequency;

a waveguide flange, having a opening formed therein;

first waveguide means, having an opening of predetermined dimensions, for propagating the RF energy along an entire length thereof to said flange opening, said first waveguide means having a first dimension of said opening that is tapered downward in a direction from said RF means to said flange opening, and having a second dimension of said opening that is constant in a direction from said RF means to said flange opening;

a quantity of material disposed uniformly within said flange opening;

impedance matching means, comprising a pair of layers disposed on both sides of said material and adjacent thereto, for propagating the RF energy through said material, thereby minimizing any reflections of the RF energy when contacting surfaces of said material; and an electrode, disposed in said material and operable to distribute an electric field across said flange opening in a predetermined direction that is both normal to a propagation direction of the RF energy and parallel to a polarization direction of the RF energy, whereby said electric field changes a corresponding refractive index of said material, thereby producing a varying path length therein, resulting in a controllable alteration of propagation phase of the RF energy.

2. The apparatus of claim 1, further comprising:

second waveguide means, disposed adjacent to said flange opening, having an opening of predetermined dimensions formed therein, for propagating the RF energy along an entire length thereof; and means, disposed after said second waveguide means, for detecting a phase shift in the RF energy.

3. The apparatus of claim 1, further comprising:

means, disposed after said flange opening, for detecting a phase shift in the RF energy.

4. The apparatus of claim 1, wherein said material disposed uniformly within said flange opening has refractive index properties which vary in the presence of an applied electric field.

5. The apparatus of claim 1, wherein said material disposed uniformly within said flange opening is ferroelectric material.

6. The apparatus of claim 5, wherein said ferroelectric material comprises any ferroelectric material having extraordinary refractive index ($n_e$) properties which vary in the presence of an applied electric field.

7. The apparatus of claim 1, wherein said material disposed uniformly within said flange opening comprises barium strontium titanate.

8. The apparatus of claim 1, wherein said impedance matching means comprises magnesium calcium titanate.

9. The apparatus of claim 2, wherein said second waveguide means has a first dimension of said opening that is tapered upward in a direction from said RF means to said flange, and has a second dimension of said opening that is constant in a direction from said RF means to said flange.

10. The apparatus of claim 1, wherein said selected frequency is within a frequency range of 1 GHz to 100 GHz.

11. Apparatus for testing the radio frequency ("RF") energy phase shifting ability of materials having refractive index properties which vary in the presence of an applied electric field, comprising:

RF means, for providing RF energy at a selected frequency;

first waveguide means, having an opening of predetermined dimensions, for propagating said RF energy along an entire length thereof;

a waveguide flange, disposed adjacent to said first waveguide means, having a opening formed therein to receive a quantity of the material, said first waveguide means having a first dimension of said opening that is tapered downward in a direction from said RF means to said flange opening, and having a second dimension of said opening that is constant in a direction from said RF means to said flange opening;

impedance matching means, comprising a pair of layers of material disposed adjacent to and on either side said flange opening, for propagating said RF energy through said flange opening, thereby minimizing any reflections of said RF energy when contacting surfaces of the material;

voltage means, for providing an electric field across said flange opening in a predetermined direction that is both normal to a propagation direction of said RF energy and parallel to a polarization direction and optic axis of said RF energy, whereby said electric field changes the refractive index of the material, thereby producing a varying path length therein, resulting in a variable propagation phase of said RF energy;

an electrically conductive plate, disposed within said material, said plate being electrically connected to said voltage means and operable to distribute said electric field in said predetermined direction;

second waveguide means, disposed adjacent to said flange on a side of said flange opposite said side of said flange adjacent to said first waveguide means, having an opening of predetermined dimensions formed therein, for propagating said RF energy along an entire length of said second waveguide means, said second waveguide means having a first dimension of said opening that is tapered upward in a direction from said RF means to said flange opening, and having a second dimension of said opening that is constant in a direction from said RF means to said flange opening; and means, disposed after said second waveguide means, for detecting a phase shift in said RF energy.

12. The apparatus of claim 11, wherein said impedance matching means comprises magnesium calcium titanate.

13. The apparatus of claim 11, wherein said selected frequency is within a frequency range of 1 GHz to 100 GHz.

* * * * *

UNITED STATES PATENT AND TRADEMARK OFFICE
CERTIFICATE OF CORRECTION

PATENT NO. : 5,206,613

DATED : April 27, 1993

INVENTOR(S) : Donald C. Collier et al.

It is certified that error appears in the above-identified patent and that said Letters Patent is hereby corrected as shown below:

On the Title Page, Item [54];
In the Title, "ELECTROPTIC" should read --ELECTROOPTIC--.

In the Title, "SHAFT" should read --SHIFT--.

Col. 1, line 1 "ELECTROPTIC" should read --ELECTROOPTIC--.

Col. 1, line 1 "SHAFT" should read -- SHIFT--.

Signed and Sealed this

Thirty-first Day of May, 1994

Bruce Lehman

*Attest:*

BRUCE LEHMAN

*Attesting Officer*

*Commissioner of Patents and Trademarks*